US009237779B2

(12) United States Patent
Berend et al.

(10) Patent No.: US 9,237,779 B2
(45) Date of Patent: Jan. 19, 2016

(54) SHOE UPPER HAVING MULTIPLE UNWELDED FLEX ZONES

(71) Applicant: Nike, Inc., Beaverton, OR (US)

(72) Inventors: Thomas Berend, Beaverton, OR (US); Douglas A. Beye, Beaverton, OR (US); Tony H. Le, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 488 days.

(21) Appl. No.: 13/766,081

(22) Filed: Feb. 13, 2013

(65) Prior Publication Data

US 2014/0223771 A1 Aug. 14, 2014

(51) Int. Cl.
*A43B 23/00* (2006.01)
*A43B 23/02* (2006.01)

(52) U.S. Cl.
CPC ..... *A43B 23/0245* (2013.01); *A43B 23/0235* (2013.01); *A43B 23/0255* (2013.01); *A43B 23/0275* (2013.01)

(58) Field of Classification Search
CPC ..... A43B 23/0255; A43B 23/027; A43B 23/0275; A43B 23/0245
USPC ..... 36/45, 57, 58
See application file for complete search history.

(56) References Cited

U.S. PATENT DOCUMENTS

| | | | | |
|---|---|---|---|---|
| 2,994,322 | A | 8/1961 | Cullen et al. | |
| 4,447,967 | A * | 5/1984 | Zaino | A43B 23/0235 36/45 |
| 5,713,399 | A | 2/1998 | Collette et al. | |
| 5,783,008 | A | 7/1998 | Belke, Jr. et al. | |
| 5,785,806 | A | 7/1998 | Engle et al. | |
| 5,894,983 | A | 4/1999 | Beck et al. | |
| 5,944,924 | A | 8/1999 | Engle et al. | |
| 6,382,494 | B1 | 5/2002 | Miller | |
| 6,450,393 | B1 | 9/2002 | Doumanidis et al. | |
| 6,519,500 | B1 | 2/2003 | White | |
| 6,520,399 | B1 | 2/2003 | Salzer et al. | |
| 6,578,753 | B1 | 6/2003 | Sakakura | |
| 6,835,257 | B2 | 12/2004 | Perrine | |
| 6,910,288 | B2 | 6/2005 | Dua | |
| 7,325,385 | B2 | 2/2008 | Nagashima et al. | |
| 7,424,783 | B2 * | 9/2008 | Meschter | A41D 1/04 2/227 |
| 7,493,191 | B1 | 2/2009 | Miller | |
| 7,776,171 | B2 | 8/2010 | Lehto et al. | |
| 7,824,513 | B2 | 11/2010 | Chernyak et al. | |
| 7,883,594 | B2 | 2/2011 | Albanese et al. | |

(Continued)

FOREIGN PATENT DOCUMENTS

| | | |
|---|---|---|
| CN | 101774077 | 7/2010 |
| CN | 201913809 | 8/2011 |

(Continued)

OTHER PUBLICATIONS

International Preliminary Report on Patentability (including Written Opinion of the ISA) dated Aug. 18, 2015 in International Application No. PCT/US2014/015904.

(Continued)

*Primary Examiner* — Ted Kavanaugh
(74) *Attorney, Agent, or Firm* — Plumsea Law Group, LLC

(57) ABSTRACT

A shoe having a shoe upper including multiple unwelded flex zones in selected locations on the shoe upper. The flex zones may be selectively located on the upper to flex when the shoe is in use.

20 Claims, 11 Drawing Sheets

(56) References Cited

U.S. PATENT DOCUMENTS

| | | | | |
|---|---|---|---|---|
| 7,952,785 | B2 | 5/2011 | Karmhag et al. | |
| 8,800,172 | B2 | 8/2014 | Dua et al. | |
| 8,844,167 | B2 | 9/2014 | Greene | |
| 2003/0148076 | A1 | 8/2003 | Huang | |
| 2006/0048413 | A1 | 3/2006 | Sokolowski et al. | |
| 2006/0189236 | A1 | 8/2006 | Davis et al. | |
| 2007/0022627 | A1 | 2/2007 | Sokolowski et al. | |
| 2007/0270969 | A1 | 11/2007 | Schmid | |
| 2007/0295440 | A1 | 12/2007 | Stucker et al. | |
| 2008/0028640 | A1* | 2/2008 | Lacorazza | A43B 3/26 36/97 |
| 2010/0018075 | A1 | 1/2010 | Meschter et al. | |
| 2010/0037483 | A1 | 2/2010 | Meschter et al. | |
| 2010/0263236 | A1 | 10/2010 | Carboy et al. | |
| 2011/0088282 | A1 | 4/2011 | Dojan et al. | |
| 2012/0023778 | A1 | 2/2012 | Dojan et al. | |
| 2012/0124866 | A1 | 5/2012 | Moriyasu et al. | |
| 2014/0173938 | A1 | 6/2014 | Beye et al. | |

FOREIGN PATENT DOCUMENTS

| | | | |
|---|---|---|---|
| DE | 102010017665 | | 1/2012 |
| EP | 0965549 | | 12/1992 |
| EP | 1495690 | A1 | 1/2005 |
| JP | 10229620 | | 8/1998 |
| JP | 2006304862 | | 11/2006 |
| WO | 9118527 | | 12/1991 |

OTHER PUBLICATIONS

International Preliminary Report on Patentability (including Written Opinion of the ISA) dated Aug. 18, 2015 in International Application No. PCT/US2014/015903.

Non-Final Office Action mailed May 20, 2015 in pending U.S. Appl. No. 13/766,065.

International Search Report and Written Opinion mailed May 16, 2014 in International Application No. PCT/US2014/015903.

International Search Report and Written Opinion mailed May 16, 2014 in International Application No. PCT/US2014/015904.

* cited by examiner

SHOE UPPER HAVING MULTIPLE UNWELDED FLEX ZONES

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. Further over lapping pieces of material may impart stability and structure to specific parts of the shoe.

As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

The present disclosure relates generally to a shoe upper having multiple welds in selected locations on the shoe upper. The welded sections may provide structure and stability to the selected locations. Further, the shoe upper may include at least one zone without welds.

In one aspect, the disclosure provides a shoe upper that may include a base material having a lateral side having multiple weld zones, multiple unwelded flex zones, and multiple eyelet portions overlaid on the base material, and a medial side having multiple weld zones, multiple unwelded flex zones, and multiple eyelet portions overlaid on the base material. Further, the eyelets portions may be selectively located on the shoe upper to allow unencumbered flexibility in the unwelded flex zones.

In another aspect, the disclosure provides a shoe that includes a shoe upper, a toe strap, a toe cap, an outer heel support and a sole structure. The shoe upper may include a base material having a lateral side and a medial side. The lateral side of the shoe upper may include multiple weld zones, multiple unwelded flex zones, and multiple eyelet portions overlaid on the base material. The medial side may include multiple weld zones, multiple unwelded flex zones, and multiple eyelet portions overlaid on the base material. The toe cap may be overlaid on the base material spanning from the medial side to the lateral side of the upper. Further, eyelets portions may be selectively located on the shoe upper to allow unencumbered flexibility in the unwelded flex zones.

In a further aspect, the disclosure provides a shoe that includes a shoe upper, a toe strap, a toe cap, an outer heel support and a sole structure. The shoe upper may include a base material having a lateral side and a medial side. The lateral side of the shoe upper may include multiple weld zones, multiple unwelded flex zones, and multiple eyelet portions overlaid on the base material. The medial side may include multiple weld zones, multiple unwelded flex zones, and multiple eyelet portions overlaid on the base material. The toe cap may be overlaid on the base material spanning from the medial side to the lateral side of the upper. Further, the unwelded flex zones may be selectively located on the shoe upper to allow unencumbered flexibility in the unwelded flex zones.

In one aspect the disclosure provides a shoe having an upper that may include additional material or strapping in selected locations in the medial side of the shoe upper. Further, the shoe upper may include welds in selected locations on the lateral side of the shoe upper. Still further, the shoe upper may include at least one flex zone that lacks welds.

In another aspect, the disclosure provides a shoe upper that utilizes multiple welds in selected locations on the upper to provide structure and stability to the shoe upper. The welds may be located on both medial and lateral sides of the shoe upper. By selectively welding the shoe upper, multiple zones where welds may be absent are also formed.

In yet another aspect, the disclosure provides a shoe upper having a base material that may include welded zones and unwelded flex zones. The upper may also include additional material over laid on the base material. Portions of the additional material may align with the weld zones.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

The shoe upper of this disclosure may be configured for use in a wide range of athletic footwear styles, including running shoes, basketball shoes, cross-training shoes, football shoes, golf shoes, hiking shoes and boots, ski and snowboarding boots, soccer shoes, tennis shoes, and walking shoes, for example. Concepts associated with the shoe upper having multiple welds in selected areas may also be utilized with footwear styles that are generally considered to be primarily non-athletic, including dress shoes, loafers, sandals, casual shoes, clogs, flats, heels, pumps, wedges, and work boots.

In addition to footwear, the concept of welding material to provide support and structure as well as to form unwelded flex zones may be incorporated into other types of apparel and athletic equipment, including helmets, gloves, and protective padding for sports, such as football and hockey. Similar material may also be incorporated into cushions and other compressible structures utilized in household goods and industrial products.

Additionally, the discussion and figures disclose various configurations of a shoe upper as a portion of a shoe. Although the concepts shown on the shoe upper are disclosed as being incorporated into footwear, the concept of welding material to provide support and structure may be utilized with a variety of other products or for a variety of other purposes.

For purposes of this disclosure, the terms "shoe upper" and "upper" may be used interchangeably. The shoe upper or upper may include all portions of the shoe, excluding the laces and the sole structure.

Figure 1:
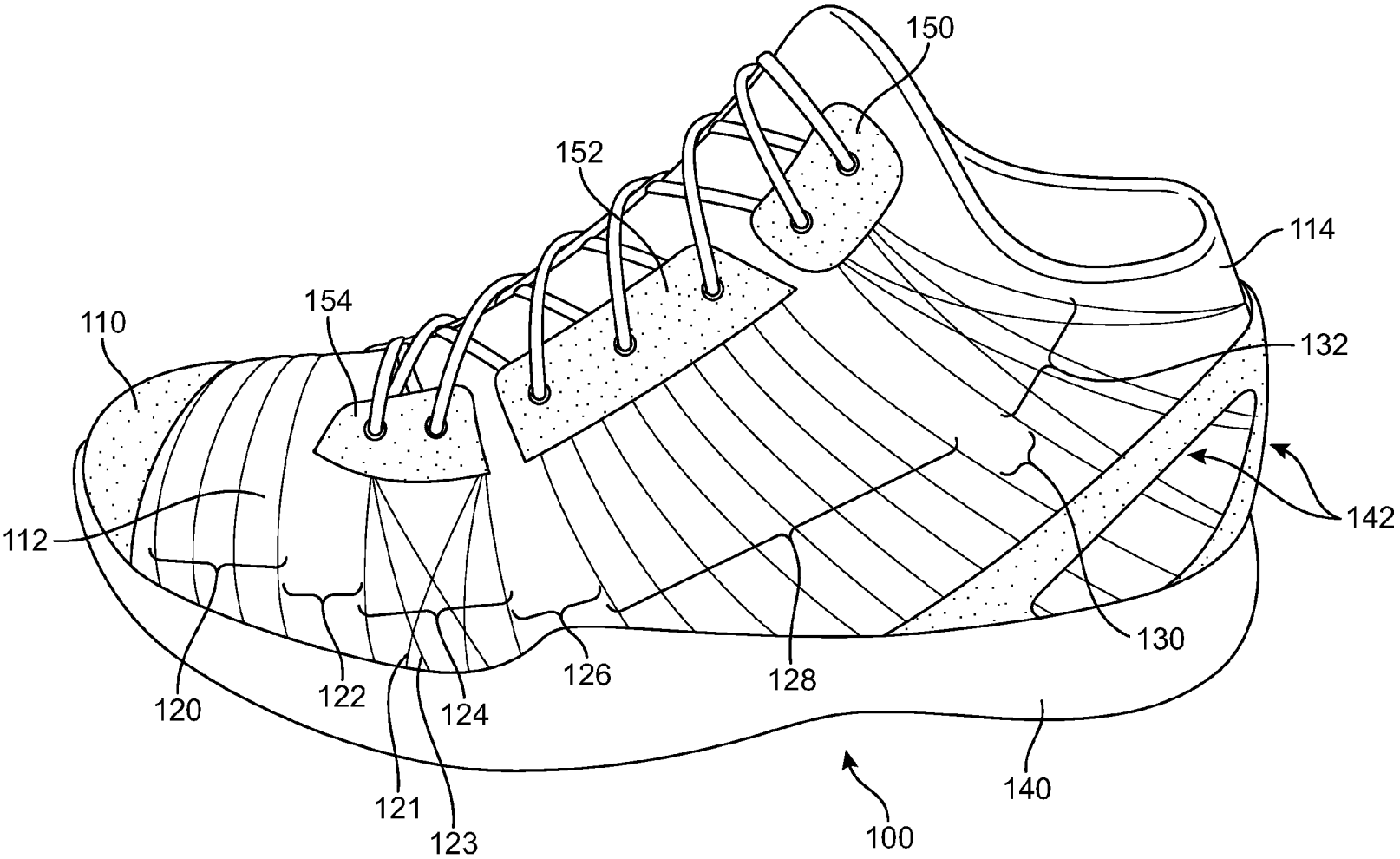
FIG. 1 is a schematic diagram of an embodiment of the lateral side of the shoe upper with selective welds.

FIG. 1 depicts an embodiment of the lateral side of shoe 100 having an upper 114 having multiple welds, such as first weld 121 and second weld 123. The multiple welds may be located in specific portions of upper 114. In some embodiments, the upper may include multiple locations or zones having multiple welds. Further, upper 114 may include multiple zones that remain unwelded.

As mentioned, portions of the shoe upper may be fused or welded. In some embodiments, the individual fibers, filaments, strands or layers that compose the base material of the upper may be fused or welded. For example, in FIG. 1 upper 114 may include base material 112. Base material may include one or more welds, such as first weld 121 and second weld 123. In the figures, the welds formed in the upper are depicted as solid lines.

The base material of the upper may be formed from any suitable material for a shoe upper. The base materials may be a woven or non-woven material. The base material may be suitable for the fusing method utilized to form the welds in the base material.

In some embodiments, the base material may be a single layer of material. In other embodiments, the base material may be two or more layers. When the base material is multiple layers, each layer may be made of the same material or combination of materials. In other embodiments, each layer of the base material may be made of different suitable materials or combination of materials. Again, the materials used for the one or more layers of the base material of the upper may be suitable for the fusion method chosen to form the welds in the base material.

As mentioned above, in some embodiments, base material 112 may be a single layer. In such embodiments, the welds include areas in which the individual fibers, filaments or strands of the layer of base material 112 are fused or melted together.

In other embodiments, base material 112 of upper 114 may include two or more layers. When base material 112 has two or more layers, the welds may include fusing one layer to other layer. In other embodiments, the top layer may only be welded, similar to a single layer base material, where the fibers, filaments or strands of the layer are fused. In multilayer base material, the welds may appear indented into the material.

The welds of the upper may be formed by any suitable method of fusing materials of a shoe upper. In some embodiments, the base material of the upper may be fused by a thermal fusion method. The thermal fusion method may include bonding through hot die, steam or hot air heating methods. In other embodiments, the base material of the upper may be fused by a welding method.

In some embodiments, welding methods may be utilized to form welds in a shoe upper. The welding method utilized to create the welds may include a high frequency welding method. The high frequency welding method may include an ultrasonic welding method or a radio frequency welding method.

In those embodiments where a high frequency welding method is utilized to form the welds in the base material of the upper, the base material may be made of any material suitable for such a method. Further, the base material may be made of any material suitable for high frequency welding methods. Materials suitable for high frequency welding include thermoplastic material or natural material coated with a thermoplastic material. Examples of material suitable for high frequency welding methods include an acrylic, a nylon, a polyester, a polylactic acid, a polyethylene, a polypropylene, polyvinyl chloride (PVC), an urethane, a natural fiber, such as cotton or wool, that is coated with one or more thermoplastic materials, such as an ethyl vinyl acetate or thermoplastic polyurethane, and combinations thereof.

In some embodiments, an ultrasonic welding device is used to fuse portions of the base material. Ultrasonic welding devices utilize high frequency ultrasonic acoustic vibrations. The vibrations may be applied locally to a portion of the base material of the shoe upper. Further, the vibrations applied to the base material cause friction. The friction softens the base material to fuse the specific portion of the material. The fusion of the selected portions of the upper may be considered a solid state weld.

Some embodiments may employ one or more of the principles, concepts or methods disclosed in the following: Albanese et al., U.S. Pat. No. 7,883,594, entitled "Wrapped pile weatherstripping and methods of making same," issued on Feb. 8, 2011; Chernyak, U.S. Pat. No. 7,824,513, entitled "Apparatus and method for making pile articles and improved pile articles made therewith," issued on Nov. 2, 2010; Lehto et al., U.S. Pat. No. 7,776,171, entitled "Arrangement and method for treatment of a material by means of an ultrasonic device," issued on Aug. 17, 2010; Perrine, U.S. Pat. No. 6,835,257, entitled "Ultrasonic weld pattern for adsorbent containing package" issued on Dec. 28, 2004; and Collette et al., U.S. Pat. No. 5,713,399, entitled "Ultrasonic seaming of abutting strips for paper machine clothing" issued on Feb. 3, 1998; the entirety of each being hereby incorporated by reference.

More specifically, in the embodiment shown in FIG. 1, the lateral side of shoe upper 114 may have multiple weld zones and multiple zones that are unwelded. First weld zone 120 may be located in toe box portion of the shoe. Second weld zone 124 may be located along the lateral side between the first eyelet portion 154 and sole structure 140. Third weld zone 128 may be located along the lateral side between the second eyelet portion 152 and the sole structure 140. Fourth weld zone 132 may be located from the third eyelet portion 150 around the ankle portion of upper 114 to outer heel support 142.

Further, in some embodiments, upper 114 may include unwelded flex zones on the lateral side of the shoe. First unwelded flex zone 122 may be located in the toe box portion of upper 114 between first weld zone 120 and second weld zone 124. First unwelded flex zone may span radially from sole structure 140 on the lateral side of upper 114 to toe strap 144 on the medial side of upper 114. First unwelded flex zone 122 may be configured to flex similarly to the flex that takes place between the toes and instep when the foot is flexed.

Second unwelded flex zone 126 may be located between second weld zone 124 and third weld zone 128. In addition, second unwelded flex zone 126 may continue between first eyelet portion 154 and second eyelet portion 152. Second unwelded flex zone 126 may be configured to flex when the foot flexes between the toes and instep. Further, second unwelded flex zone 126 may be configured to flex when the foot flexes between the instep and the ankle.

Third unwelded flex zone 130 may be located between third weld zone 128 and fourth weld zone 132. Like second unwelded flex zone 126, third unwelded flex zone 132 may continue between second eyelet portion 152 and third eyelet portion 150. Third unwelded flex zone 130 may be configured to flex when the foot flexes between the instep and the ankle.

In addition to the weld zones and unwelded flex zones, shoe upper 114 may also include additional materials. The additional materials may be overlaid on base material 112 of upper 114. For example, in FIG. 1, upper 114 of shoe 100 may include toe cap 110. Toe cap 110 may be formed from additional material. The additional material may be overlaid on base material 112. Toe cap 110 may span from the medial side to the lateral side of upper 114 in the toe box portion of the upper.

The additional materials may include any suitable material for a shoe upper. The suitable material may include woven textiles, nonwoven textiles, polymer sheet layers, plastics, rubbers, foam layers, leather, and synthetic leather. Further, the additional materials may include the same materials recited above as suitable for the base material. In some embodiments, the base material and the additional material may be different. In other embodiments, the base material and additional material may be the same.

Upper 114 of shoe 100 may further include heel support 142. Heel support 142 may be formed from additional material. The additional material may be overlaid on base material 112 of the upper. Heel support 142 may span from the medial side to the lateral side of upper 114 wrapping around the heel portion of the upper. Further, heel support 142 may be in contact with sole structure 140.

Each weld zone may include any number of welds. The number of welds in each weld zone may depend on the amount of support and structure the desired for that particular zone. In addition, the welds may be formed in each weld zone in any suitable pattern. In some cases, the amount of support and structure desired for each zone may determine the number of welds as well as the pattern of welds.

The weld or welds described above may be used to vary one or more properties of the upper. In some embodiments, the weld or welds may provide a base material that stretches less in any direction in that specific location. The weld or welds formed in the base material may restrain the base material from stretching in a lateral direction. The weld or welds formed in the base material may restrain the base material from stretching in a longitudinal direction. Further, the weld or welds formed in the base material may restrain the base material from stretching in both a lateral and longitudinal direction. In other words, the weld or welds formed in the base material provide similar support and structure to an upper that the inclusion of additional material in those same areas would if the additional material had been applied.

The weld or welds may also be used to reduce bending of the base material. In some embodiments, the weld or welds may increase the strength of the base material. In other embodiments, the weld or welds may increase the rigidity of the base material of the upper. Further, the weld or welds may reduce the flexibility of the base material of the upper in the weld zones.

In contrast, the unwelded flex zones of the upper may not restrain the base material from stretching or flexing. The unwelded flex zones are left unwelded in selected locations on the upper. The locations may be areas the shoe flexes during use. The upper of the shoe may flex in the same location and manner that the foot inside the shoe flexes. Therefore, the shoe upper of this disclosure not only may include welds formed in selected locations impart support and structure in those locations, but the shoe upper may include unwelded areas that also may be selectively located on the upper.

During activities that involve walking, running, or other ambulatory movements (e.g., cutting, braking), a foot within the shoes described above may tend to stretch the upper component of the shoe. That is, many of the material elements forming the upper (e.g., base material of the upper) may stretch when placed in tension by movements of the foot. Although the welds of the upper may also stretch, the welds generally stretch to a lesser degree than the other material elements forming the upper. The various welds of the upper may be located on the upper, therefore, to form structural components in the upper that (a) resist stretching in specific directions or locations, (b) limit excess movement of the foot relative to the sole structure and the upper, (c) ensure that the foot remains properly positioned relative to the sole structure and the upper, and/or (d) reinforce locations where forces are concentrated. In addition, the unwelded flex zones may be located on the upper to ensure that the upper of the shoe flexes in a substantially similar manner that the foot inside the shoe flexes.

For example, it may be desirable to have first weld zone 120 of the toe box portion of the upper or third weld zone 128 remain flexible in certain directions. First weld zone 120 and third weld zone 128 may be selected to remain flexible in the longitudinal direction (heel to toe direction) but less flexible in the lateral direction (instep to sole direction).

Each weld zone may include provisions for reducing the stretching of the base material. Further, each zone may include provisions for reducing the bending of the base material. In some embodiments, each zone may include provisions for increasing the strength of the base material. Still further, each zone may include provisions for increasing the rigidity of the base material of the upper. In other embodiments, each zone may include provisions for reducing the flexibility of the base material of the upper.

Generally, the welds of each weld zone may be oriented in any direction. In some embodiments, the welds may be located on the upper in a longitudinal, or lengthwise, direction. In other embodiments, the welds of a weld zone may be located in a lateral, or widthwise, direction. Further, the welds of a weld zone may be located in a diagonal direction, which is a direction between the longitudinal and lateral directions.

In some embodiments, the welds of a particular weld zone may not intersect. Further, the welds of a particular weld zone may be in the same direction. In other embodiments, two or more welds of a weld zone may intersect. Further, the welds of a weld zone may intersect more than one other weld. In some weld zones, some welds intersect while others do not. The degree of intersection may determine how much the stretch, bending, or flexibility of the material is reduced, and how much the strength and rigidity is increased.

Again, the welds may be located on the upper in any direction. The welds themselves may be formed in any shape. In some embodiments, the shape of the weld may be a solid line. In other embodiments, the shape of the weld may be a broken or dashed line. In further embodiments, the shape of the weld may be a wavy line. In still further embodiments, the shape of the weld may be a zigzag pattern. In addition, each weld of a weld zone may have a different weld pattern. Further still, each weld zone may include a different set of weld patterns.

As an example, in first weld zone 120 shown in FIG. 1, the series of welds are located radially across the toe of the upper from the lateral side to the medial side of the upper. In addition, third weld zone 128 may also include a series of welds that are located in substantially the same direction. In third weld zone 128, the welds may be located from second eyelet portion 152 to sole structure 140.

As another example, the second weld zone 124 between first eyelet portion 154 and sole structure 140 as well as fourth weld zone 132 in the ankle portion of the upper may be selected as an area that needs additional support. In other words, weld zones in which additional support is needed, such as second weld zone 124, may be selected to be less flexible. Further, such weld zones may be less stretchable. Still further, weld zones having added support may be less bendable. In addition, such weld zone may be stronger and/or more rigid in multiple directions. In order to achieve one or more of those characteristics, multiple welds may be formed in this zone. Further, the welds may be formed in multiple directions. In addition, some of the welds may intersect.

As can be seen in FIG. 1, the welds of second weld zone 124 and fourth weld zone 132 may not be formed in the same general direction. The welds of each zone may be formed in multiple directions. Further, the welds of each zone may intersect. The intersections may restrain the flexibility, stretch and/or bend of each zone in multiple directions. Further, the weld intersection may further increase the strength and rigidity of the weld zone. For example, the flexibility of second weld zone 124 and fourth weld zone 132 may be restricted in both the lateral and longitudinal directions. Again, the number of welds and the pattern of welds may depend on the degree of support and structure needed in each weld zone.

Figure 2:
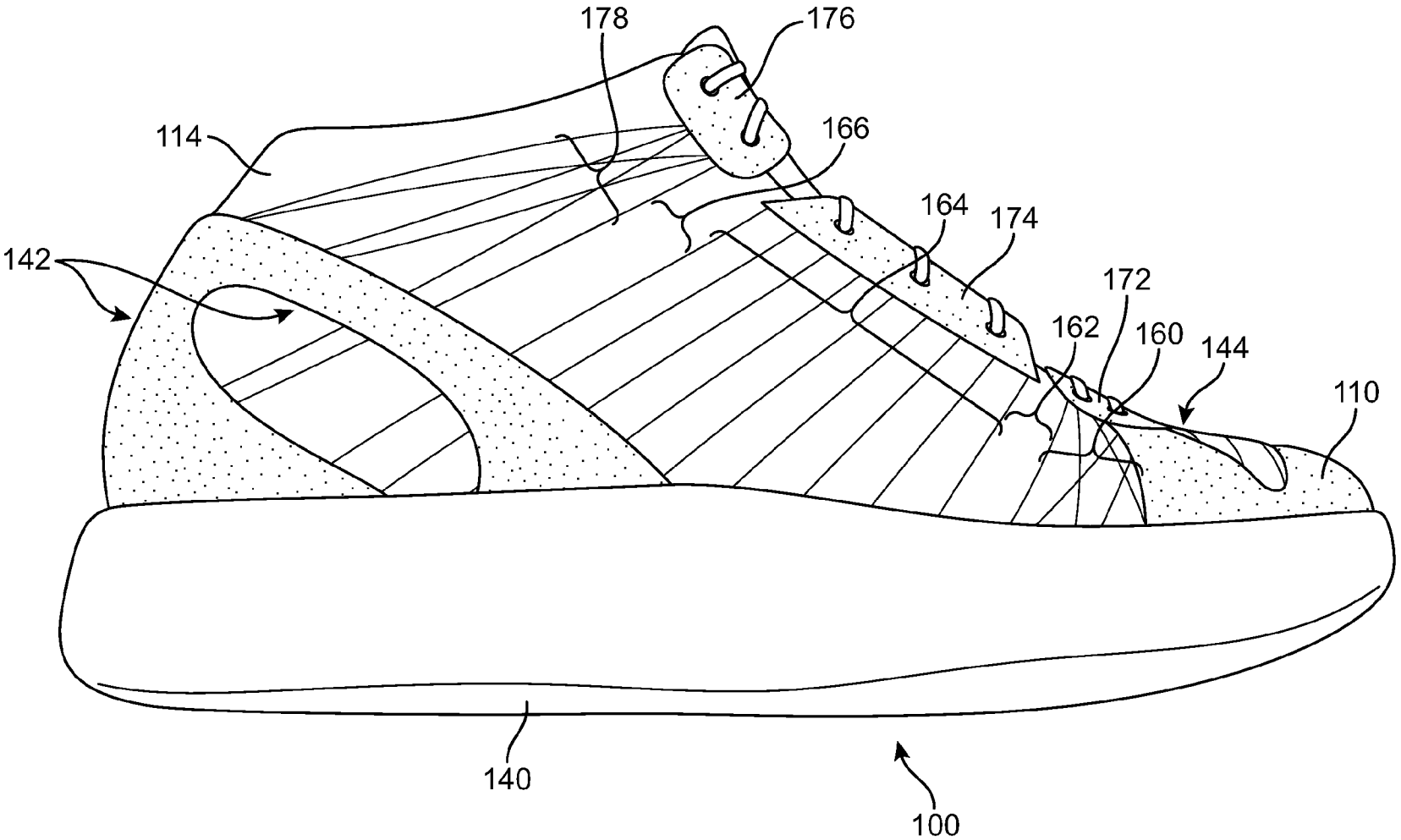
FIG. 2 is a schematic diagram of an embodiment of the medial side of the shoe upper with additional material and selective welds.

FIG. 2 depicts an embodiment of the medial side of shoe 100. Similar to the lateral side of upper 114 shown in FIG. 1, the medial side of upper 114 may have multiple weld zones. Further, the medial side also may include unwelded zones. Unlike the lateral side of upper 114, the medial side of upper 114 also includes additional material is certain locations.

More specifically, the medial side of upper 114 may include additional material in selected areas. As can be seen in FIG. 2, additional material is added as toe strap 144. Toe strap 144 is an additional piece of material that may be located over or on top of the upper base material. This additional material may provide support and stability this selected area. Toe strap 144 may provide additional forefoot support when a person wearing shoe 100 moves or cuts.

In addition to additional material added to the medial side of upper 114, as stated above, the medial side of upper 114 includes multiple weld zones. Fifth weld zone 160 is located adjacent to toe strap 144. Fifth weld zone 160 is located between the fourth eyelet portion 172 and sole structure 140. Similarly to second weld zone 124, fifth weld zone 160 may include multiple welds. The welds of fifth weld zone 160 may be formed in multiple directions. The welds of fifth weld zone 160 may intersect.

Further, the medial side of upper 114 may include sixth weld zone 164. Similar to third weld zone 128, sixth weld zone 164 may remain flexible in certain directions. Sixth weld zone 164 may be selected to remain flexible in the longitudinal direction but less flexible in the lateral direction. In such a case, sixth weld zone 164 may include a series of welds that generally may be in the same direction. More specifically, in sixth weld zone 164, the welds are formed from fifth eyelet portion 174 to sole structure 140.

The medial side of the embodiment shown in FIG. 2 also may include seventh weld zone 178. Seventh weld zone 178 may be similar to fourth weld zone 132 shown in FIG. 1. In some embodiments, the welds of seventh weld zone 178 may not be formed in the same general direction. In some embodiments, the welds of seventh weld zone 178 may be formed in multiple directions. Further, the welds of seventh weld zone 178 may intersect. The intersections may restrain the flexibility or stretchability of the weld zone in multiple directions. For example, the flexibility or stretchability of seventh weld zone 178 may be restrained in both the lateral and longitudinal directions. Again, the number of welds and the pattern of welds in seventh weld zone 178 may depend on the degree of support and structure needed in each weld zone.

Further, the medial side of upper 114 also may include unwelded flex zones. Fourth unwelded flex zone 162 may be located between fifth weld zone 160 and sixth weld zone 164. In addition, fourth unwelded flex zone 162 may continue between fourth eyelet portion 172 and fifth eyelet portion 174. Fourth unwelded flex zone 162 may be configured to flex when the foot flexes between the toes and instep. Further, fourth unwelded flex zone 162 may flex when the foot flexes between the instep and the ankle.

Fifth unwelded flex zone 166 may be located between second weld zone 164 and ankle strap 170. Fifth unwelded flex zone 166 may continue between fifth eyelet portion 174 and sixth eyelet portion 176. Fifth unwelded flex zone 164 may be configured to flex when the foot flexes between the instep and the ankle.

For the medial side of the shoe, the number of welds and the pattern of welds may depend on the degree of support and structure needed in each weld zone. In some embodiments, the number of weld zones on the medial side of upper 114 may be the same as the number of weld zones on the lateral side of upper 114. In other embodiments, the number of weld zones on the medial side of upper 114 may be different than the number of weld zones on the lateral side of upper 114. Further, each weld zone may include a different or unique weld pattern when compared the other weld zones of upper 114.

Figure 3:
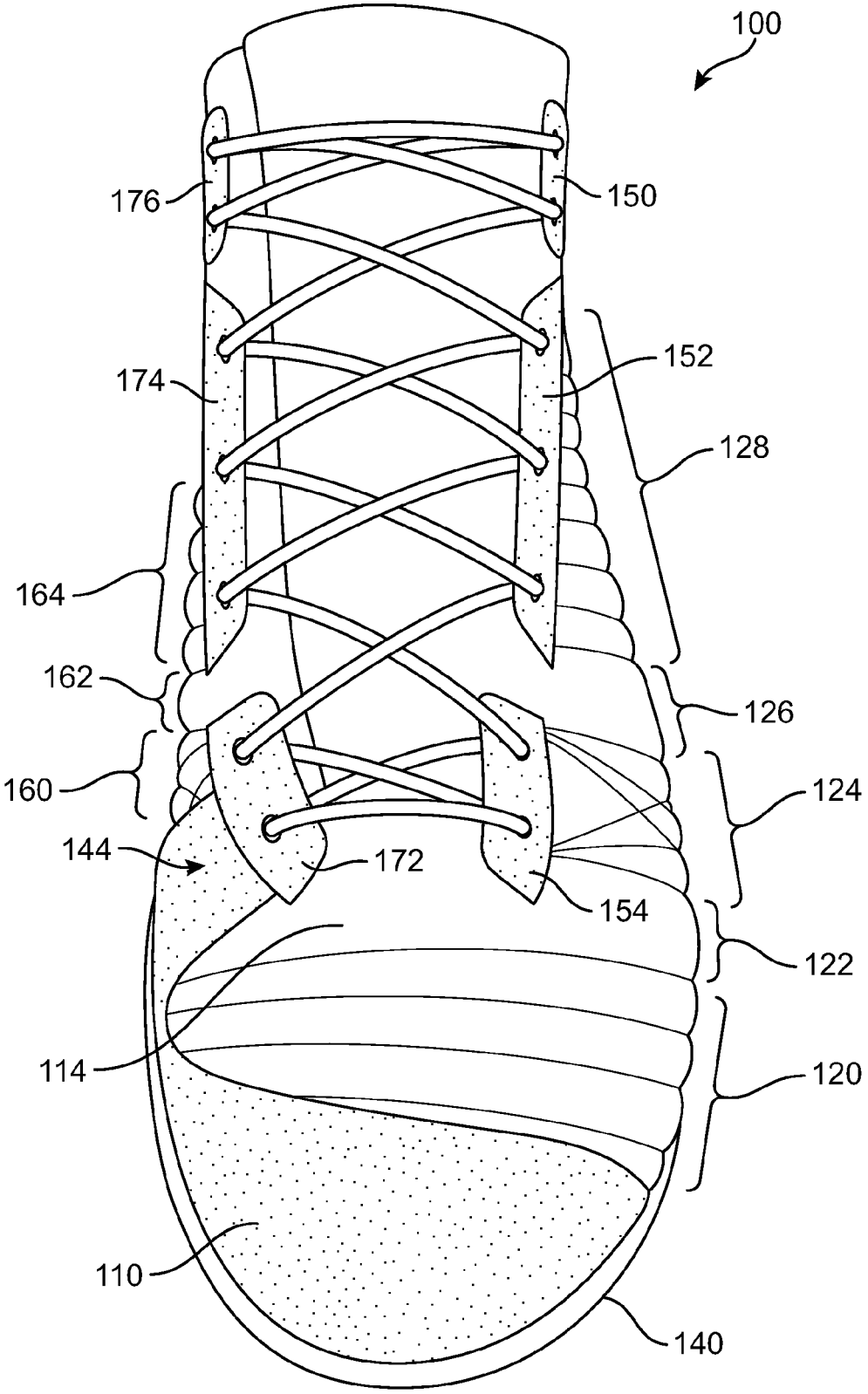
FIG. 3 is a schematic diagram of an embodiment of a shoe upper showing the toe and instep portion of the upper.

FIG. 3 depicts a top view of an embodiment of the toe portion and instep portion of shoe 100. FIG. 3 shows the multiple weld zones and unwelded zones of shoe 100 on both the medial side and the lateral side of the shoe. Further, toe strap 144 is shown on the medial side of upper 114. Toe strap 144 may span from sole structure 140 to fourth eyelet portion 172. Toe strap 144 may be affixed to the base material of the upper of shoe 100. In some embodiments, toe strap 144 may be affixed to the base material with stitching or an adhesive material. Toe strap 144 may help the foot to remain in the proper location within shoe 100 while a wearer is moving.

As can be seen in FIG. 3, the lateral side of shoe 100 lacks additional material in the approximately the same area. However, the lateral side of shoe 100 has second weld zone 124.

As described above, second weld zone 124 may include multiple welds. The welds of second weld zone 124 may also intersect. The series of welds in second weld zone 124 may provide the necessary support for this portion of upper 114. Second weld zone 124 may provide support for the wearer of shoe 100 in order for the wearer's foot to remain in the proper location within the shoe. In other words, second weld zone 124 may perform the same function on the lateral side of shoe 100 as toe strap 144 performs on the medial side of shoe 100. In some cases, second weld zone 124 may be characterized as an extension of toe strap 144. Forming a weld zone in place of a second toe strap on the lateral side of the shoe may lighten the shoe, decrease the cost of the shoe's materials, and reduce the complexity of the manufacturing process.

In addition, the top view of FIG. 3 illustrates lateral side of upper 114 and medial side of upper 114 may have corresponding welded and unwelded zones. More specifically, as can be seen in FIG. 3, second unwelded flex zone 126 on the lateral side of shoe 100 may correspond to fourth unwelded flex zone 162 on the medial side of shoe 100.

Figure 4:
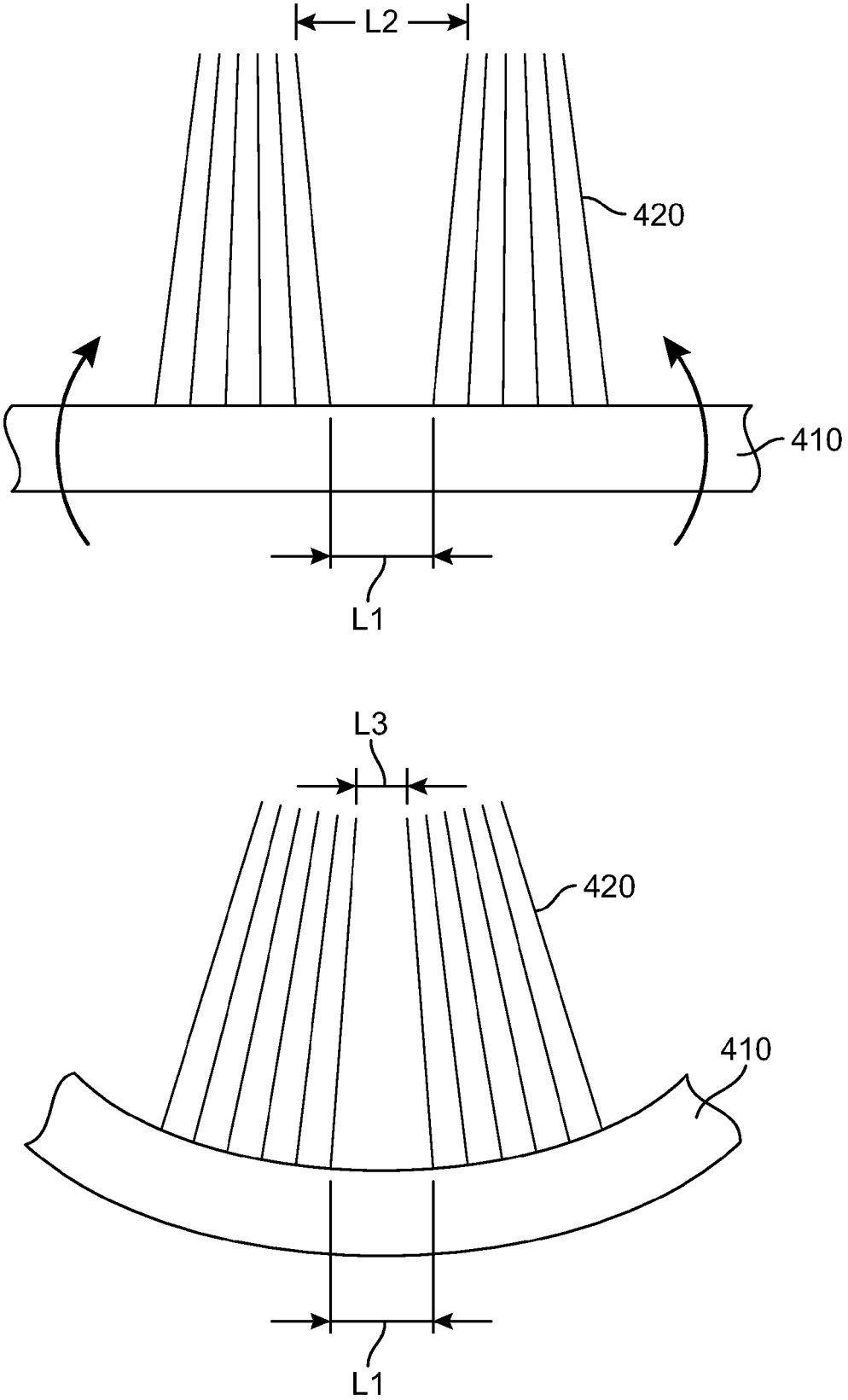
FIG. 4 is a schematic diagram of the effects of items attached to a rigid member as it flexes.

FIG. 4 is a schematic diagram of the concept of positional relationships of items attached to a rigid member as it flexes. This concept may be applied to the welds and weld zones of a shoe upper (the items) and sole structure (rigid member), which is discussed in further detail below.

As can be seen in FIG. 4, the lines or items 420 in two zones may be fixed to rigid member 410. At rest, the zones containing items 420 may be spaced a certain distance apart, L1, where the zones contact the rigid member. Further, at rest, the zones may be a second distance apart from each other (L2) at a specific distance away from the rigid member.

In contrast, as rigid member 410 flexes, the distance between the zones where the zone contact rigid member 410 remains constant. L1 does not change. However, as rigid member 410 flexes, the distance between the zones (L3) decreases.

Figure 5:
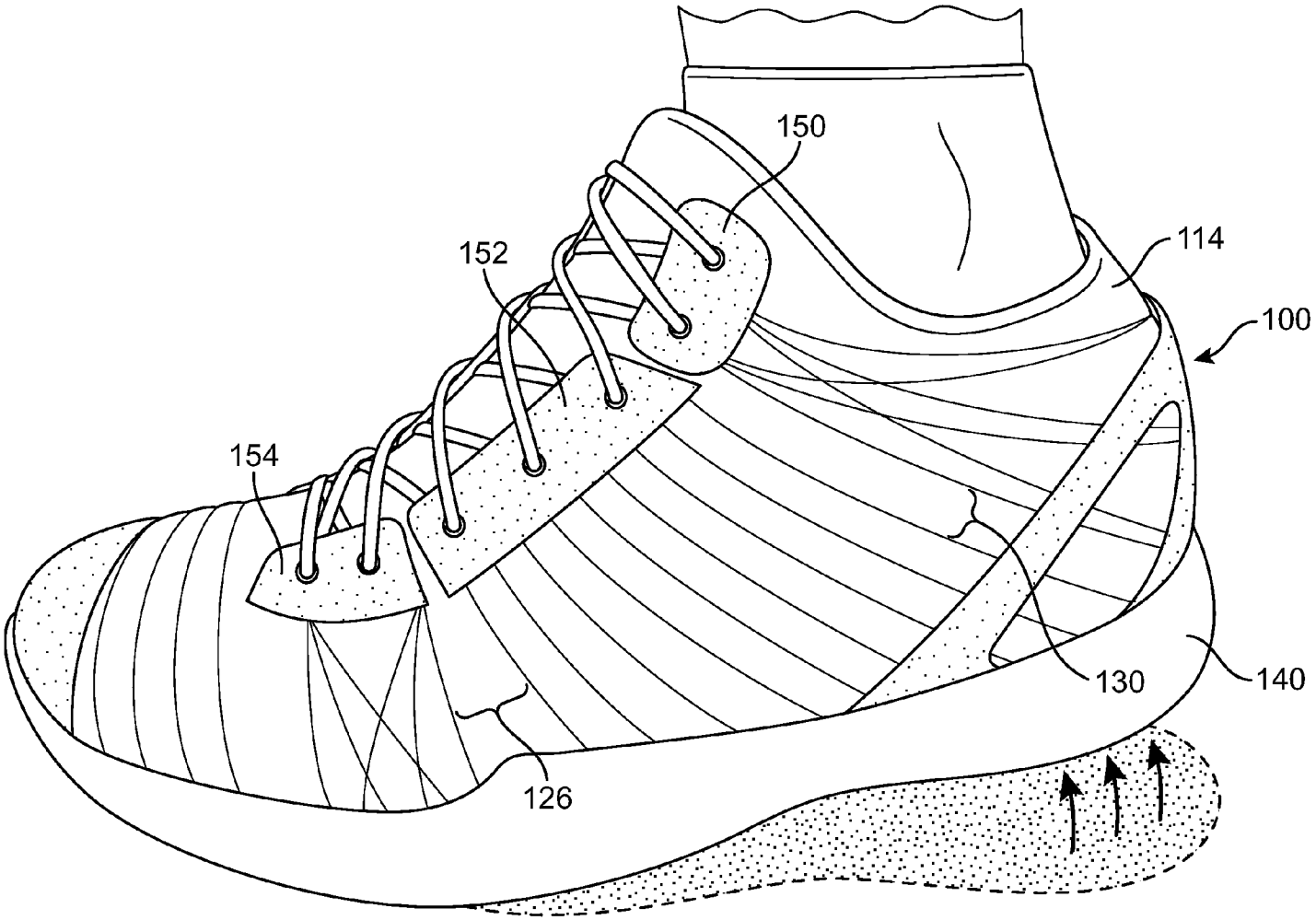
FIG. 5 is a schematic diagram of an embodiment of the shoe as it flexes.

FIG. 5 depicts the embodiment of a shoe as shown in FIG. 1 as it flexes during use. The concept depicted in the illustrations of FIG. 4 above may be applied to a shoe in use as it flexes. When a shoe is worn and in use, the user's heel comes off the ground as the user strides. As the heel of the shoe comes off the ground, the portions of shoe 100, including portions of upper 114 and sole structure 140, may flex. For example, as sole structure 140 flexes, second flex zone 126 and third flex zone 130 may flex. When these zones flex, the weld zones bordering each flex zone move closer together. This is shown in greater detail below in FIGS. 10, 11, 14 and 15.

Figure 6:
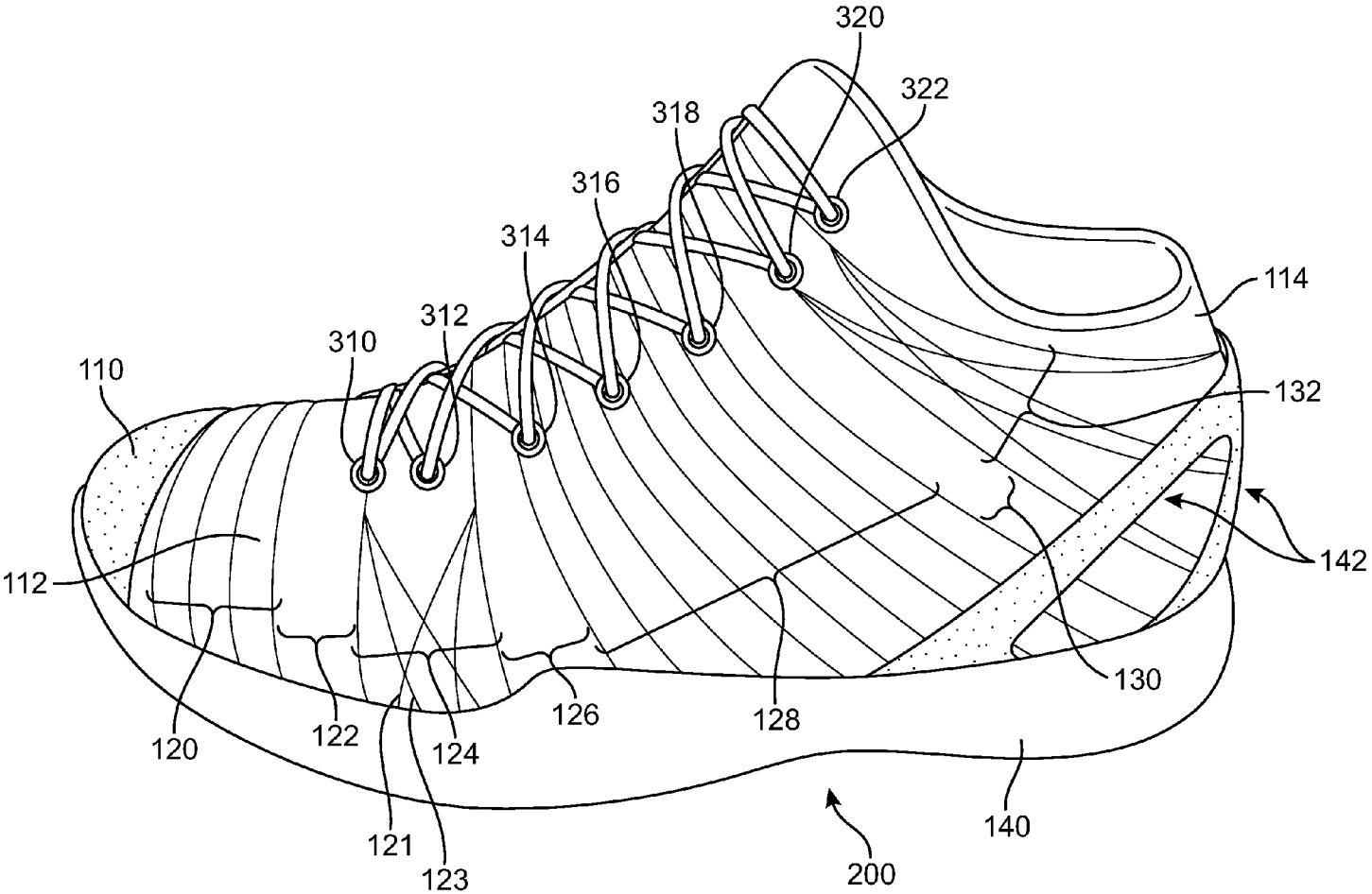
FIG. 6 is a schematic diagram of another embodiment of the lateral side of a shoe upper with selective welds.

FIG. 6 depicts a schematic of another embodiment of the lateral side of shoe 200. The embodiment shown in FIG. 6 is similar to the embodiment shown in FIG. 1. However, the embodiment shown in FIG. 6 may not include extra material on shoe upper 114, such as the eyelet portions. Instead, shoe upper 114 may include primarily the base material and a series of selective welds.

Similar to FIG. 1, FIG. 6 depicts an embodiment of the lateral side of shoe 200 having an upper having multiple welds. The multiple welds may be located in specific portions of upper 114. In some embodiment, upper 114 may include multiple locations or zones having multiple welds. Further, upper 114 may include multiple zones that remain unwelded.

More specifically, in the embodiment shown in FIG. 6, the lateral side of upper 114 may have multiple weld zones and multiple zones that are unwelded. First weld zone 120 may be located in the toe box portion of shoe 200. Second weld zone 124 may be located along the lateral side between first eyelet 310 and second eyelet 312 and sole structure 140. Third weld zone 128 may be located along the lateral side between the third eyelet 314, fourth eyelet 316, and fifth eyelet 318, and the sole structure 140. Fourth weld zone 132 may be located from the sixth eyelet 320 and seventh eyelet 322, around the ankle portion of upper 114 to outer heel support 142.

Further, upper 114 may include unwelded flex zones on the lateral side of shoe 200. First unwelded flex zone 122 may be located in the toe box portion of upper 114 between first weld zone 120 and second weld zone 124. First unwelded flex zone may span radially from sole structure 140 on the lateral side of upper 114 to toe strap 144 on the medial side of the upper. First unwelded flex zone 122 may be configured to flex similarly to the flex that takes place between the toes and instep when the foot is flexed.

Second unwelded flex zone 126 may be located between second weld zone 124 and third weld zone 128. In addition, second unwelded flex zone 126 may continue between second eyelet 312 and third eyelet 314. Second unwelded flex zone 126 may be configured to flex when the foot flexes between the toes and instep. Further, second unwelded flex zone 126 may be configured to flex when the foot flexes between the instep and the ankle.

Third unwelded flex zone 130 may be located between third weld zone 128 and fourth weld zone 132. Like second unwelded flex zone 126, third unwelded flex zone 132 may continue between fifth eyelet 318 and sixth eyelet 320. Third unwelded flex zone 130 may be configured to flex when the foot flexes between the instep and the ankle.

Figure 7:
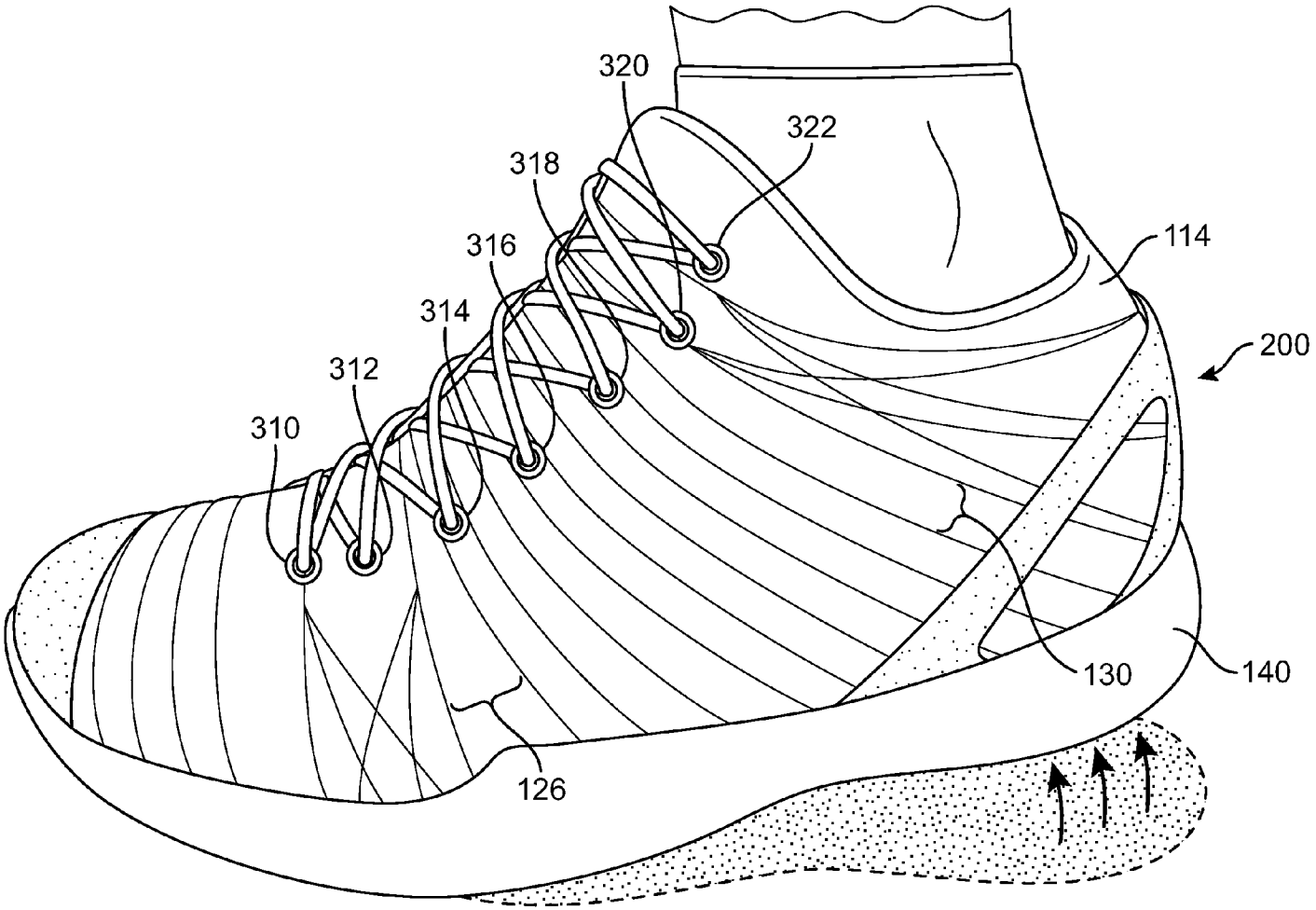
FIG. 7 is a schematic diagram of the embodiment of FIG. 6 as it flexes.

FIG. 7 depicts the embodiment of shoe 200, as shown in FIG. 6, as it flexes during use. Again, the concept depicted in the illustrations of FIG. 4 above may be applied to a shoe in use as it flexes. When a shoe is worn and in use, the user's heel comes off the ground as the user strides. As the heel of the shoe comes off the ground, the rest of the shoe, including the upper and sole structure, may flex. For example, as sole structure 140 flexes, second flex zone 126 and third flex zone 130 may flex. When these flex zones are flexed, the weld zones bordering each flex zone move closer together. This is shown in greater detail below in FIGS. 8, 9, 12 and 13.

Figure 8:
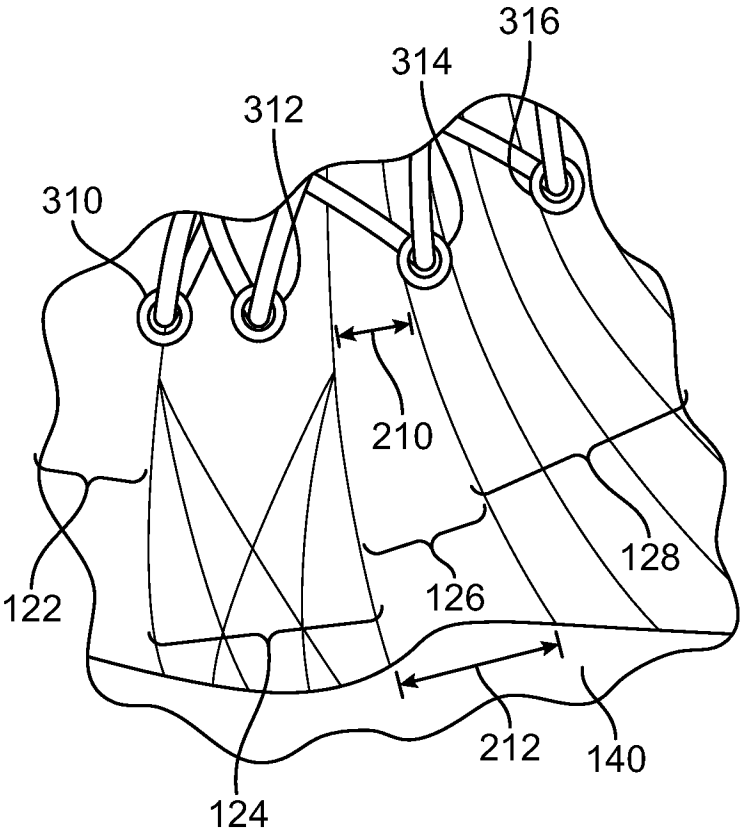
FIG. 8 is a schematic diagram of a portion of an embodiment of a shoe upper in the unflexed position.

FIG. 8 illustrates the concept of flexing described above in FIG. 4. FIG. 8 depicts a portion of shoe 200 in an unflexed state, as shown in FIG. 6. The illustrations focus on second unwelded flex zone 126. The illustration of FIG. 8 depicts this portion of shoe 200 when the shoe is at rest or in its unflexed position. Second unwelded flex zone 126 may be located between second weld zone 124 and third weld zone 128. Second unwelded flex zone 126 may continue from sole structure 140 through and between the lace eyelets. At rest, the distance between second weld zone 124 and third weld zone 128 at a specific distance from the sole structure in second unwelded zone 126 is indicated as spacing 210. The distance between second weld zone 124 and third weld zone 128 where each weld zone contacts or is fixed to the sole structure in second unwelded zone 126 is indicated as spacing 212.

Figure 9:
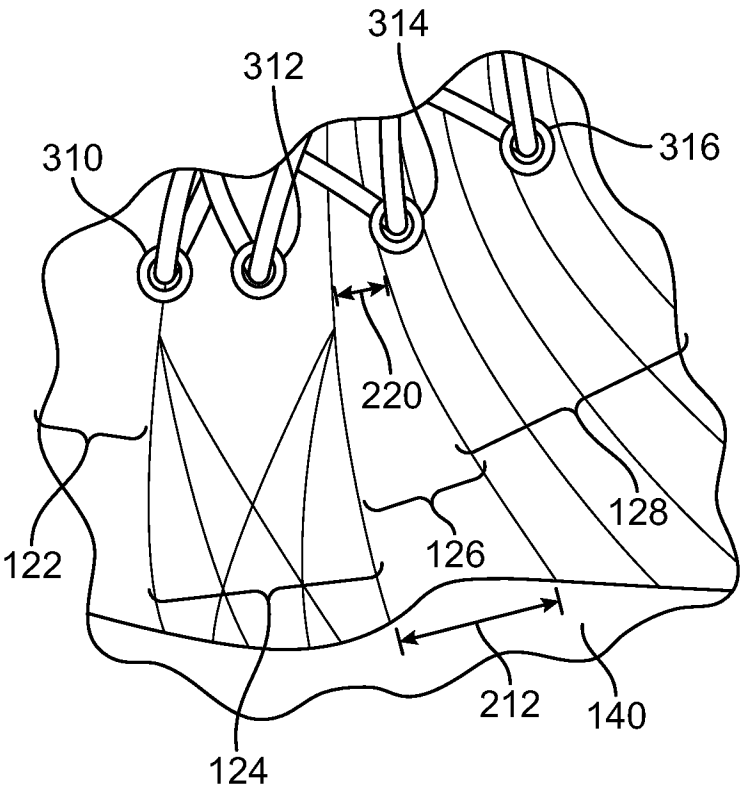
FIG. 9 is a schematic diagram of a portion of an embodiment of a shoe upper in the flexed position.

The illustration of FIG. 9 depicts the same portion of shoe 200 shown in FIG. 8. However, the illustration of FIG. 9 shows the portion of shoe 200 in a flexed state, as shown in FIG. 7. Similar to FIG. 8, the illustration of FIG. 9 depicts an embodiment of second unwelded flex zone 126 located between second weld zone 124 and third weld zone 128. Further, the distance between second weld zone 124 and third weld zone 128 at a specific distance from sole structure 140 in second unwelded zone 126 is indicated as spacing 220.

FIG. 9 depicts the movement that takes places in second unwelded flex zone 126 during use. When at rest, the unwelded flex zone may be in its original position (FIG. 8). However, when in use and flexed, the unwelded flex zone may flex as sole structure 140 flexes. As can be seen in the illustration of FIG. 9, as the second unwelded flex zone 126 flexes, the distance between second weld zone 124 and third weld zone 128 at a specific distance from the sole structure in second unwelded zone 126 changes. In other words, spacing 220 may be substantially smaller than spacing 210. However, spacing 212 (shown in both FIG. 8 and FIG. 9), which is a distance between second weld zone 124 and third weld zone 128 along sole structure 140, remains substantially the same in both the unflexed and flexed positions.

As shown in the comparative illustrations of FIGS. 8 and 9, the unwelded flex zone of the embodiment of the shoe upper may be selectively located on the upper to flex in a similar manner as the foot inside the shoe flexes. In addition, the eyelets may also be selectively located on the upper to allow the unwelded flex zone to flex unencumbered when the shoe flexes. A shoe upper having flex zones that mimic the flexing of the foot may provide a more comfortable shoe. Further, a shoe upper having flex zones may limit excess movement of the foot relative to the sole structure and the upper. Further, a shoe upper having flex zones may ensure that the foot remains properly positioned relative to the sole structure.

Figure 11:
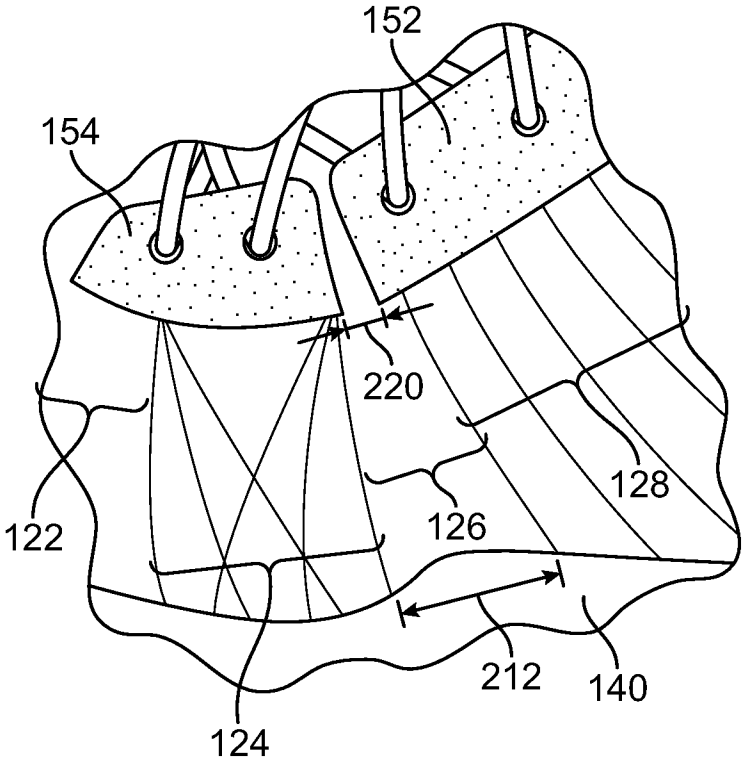
FIG. 11 is a schematic diagram of a portion of another embodiment of a shoe upper in the flexed position.
Figure 10:
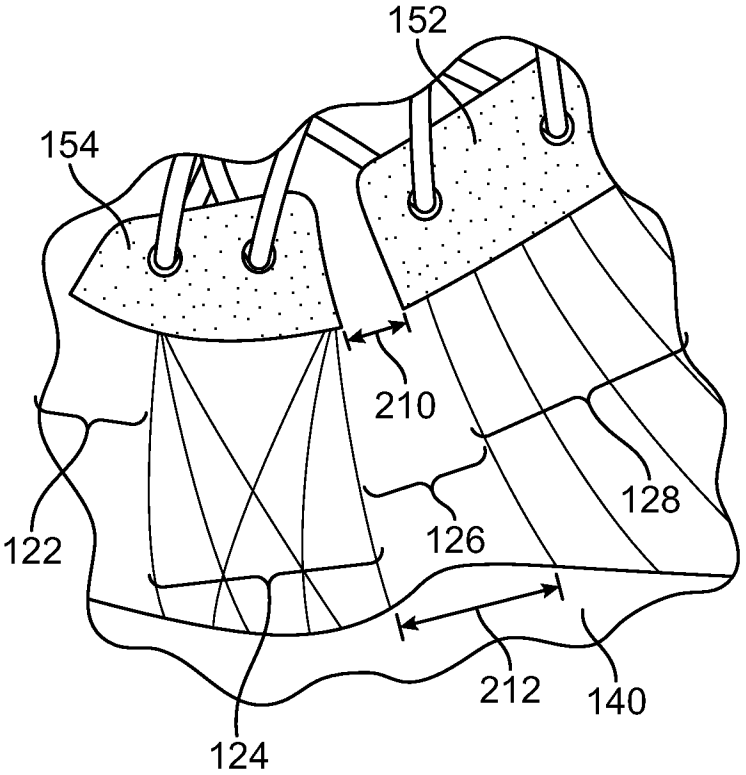
FIG. 10 is a schematic diagram of a portion of another embodiment of a shoe upper in the unflexed position.

FIGS. 10 and 11 show a portion of shoe 100 in a flexed and unflexed state. The illustrations again focus on second unwelded flex zone 126. The illustration of FIG. 10 depicts this portion of the shoe when the shoe is at rest or in its unflexed position, as shown in FIG. 1. Second unwelded flex zone 126 may be located between second weld zone 124 and third weld zone 128. Further, first eyelet portion 154 and second eyelet portion 152 are also shown. First eyelet portion 154 may be located adjacent to second weld zone 124. Second eyelet portion 152 may be located adjacent to third weld zone 128. Second unwelded flex zone 126 may continue between the weld zones from sole structure 140 through and between first eyelet portion 154 and second eyelet portion 152. The distance between first eyelet portion 154 and second eyelet portion 152 in second unwelded zone 126 is indicated as spacing 210. The distance between second weld zone 124 and third weld zone 128 where each weld zone contacts sole structure 140 in second unwelded zone 126 is indicated as spacing 212.

FIG. 11 depicts the same portion of shoe 100 as is shown FIG. 10. However, the illustration of FIG. 11 shows the portion of the shoe in a flexed state, as shown in FIG. 5. Similar to FIG. 10, the illustration of the right depicts an embodiment of second unwelded flex zone 126 located between second weld zone 124 and third weld zone 128. Further, second unwelded flex zone 126 also is located between first eyelet portion 154 and second eyelet portion 152. Still further, the distance between first eyelet portion 154 and second eyelet portion 152 is indicated as spacing 220. The distance between second weld zone 124 and third weld zone 128 where each weld zone contacts sole structure 140 in second unwelded zone 126 is indicated as spacing 212.

The illustration of FIG. 11 depicts the movement that takes places in second unwelded flex zone 126 during use. When at rest, the unwelded flex zone may be in its original position (FIG. 10). However, when in use and flexed, second unwelded flex zone 126 may flex as sole structure 140 flexes. As can be seen in FIG. 11, as the second unwelded flex zone 126 flexes, the distance between first eyelet portion 154 and second eyelet portion 152 changes. In other words, spacing 220 may be substantially smaller than spacing 210. However, spacing 212 (shown in both FIG. 10 and FIG. 11), which is a distance between second weld zone 124 and third weld zone 128 along sole structure 140, remains substantially the same in both the unflexed and flexed positions.

As shown in the comparative illustrations of FIGS. 10 and 11, the unwelded flex zone of the embodiment of the shoe upper may be selectively located on the upper to flex in a similar manner as the foot inside the shoe flexes. In addition, the material surrounding the eyelets may also be selectively located on the upper to allow the unwelded flex zone to flex unencumbered when the shoe flexes. A shoe upper having flex zones that mimic the flexing of the foot may provide a more comfortable shoe. Further, a shoe upper having flex zones may limit excess movement of the foot relative to the sole structure and the upper. Further, a shoe upper having flex zones may ensure that the foot remains properly positioned relative to the sole structure.

Figure 13:
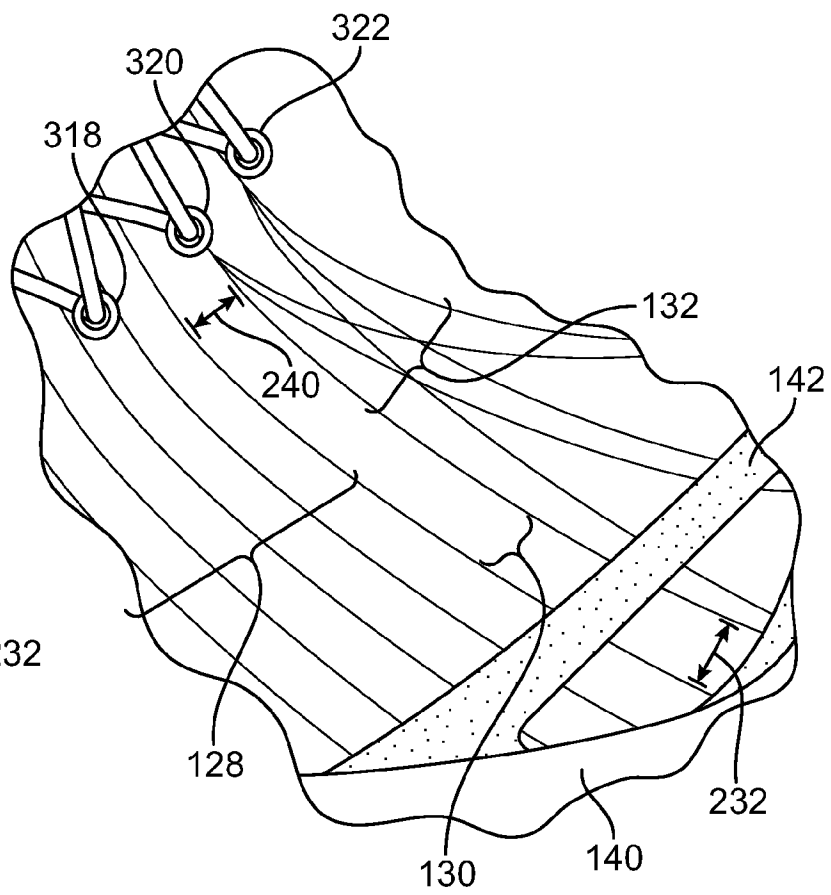
FIG. 13 is a schematic diagram of a portion of an embodiment of a shoe upper in the flexed position.
Figure 12:
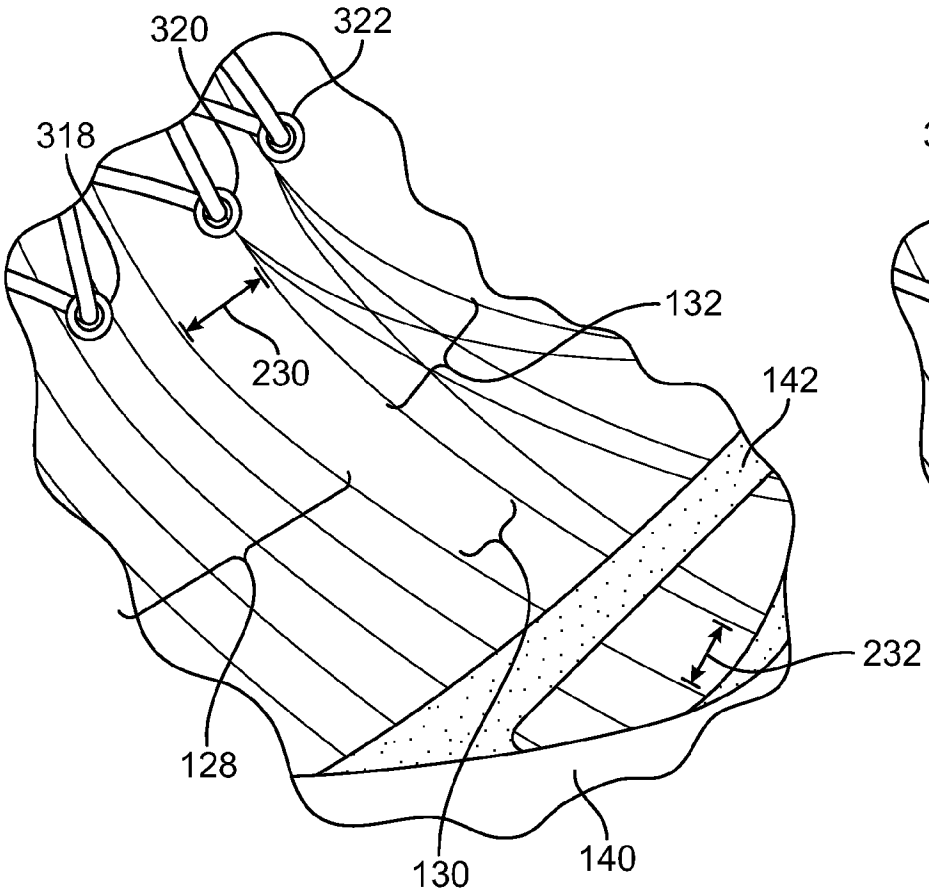
FIG. 12 is a schematic diagram of a portion of an embodiment of a shoe upper in the unflexed position.

Much like the comparative illustrations of FIGS. 8 and 9, the illustrations of FIGS. 12 and 13 depict another weld zone of shoe 200 in the flexed and unflexed state. The illustration of FIG. 12 depicts a portion of shoe 200 in its unflexed position, as shown in FIG. 6. Third unwelded flex zone 130 may be located between third weld zone 128 and fourth weld zone 132. Third unwelded flex zone 130 may continue from sole structure 140 through and between the lace eyelets. At rest, the distance between third weld zone 128 and fourth weld zone 132 at a specific distance from the sole structure in third unwelded zone 130 is indicated as spacing 230. The distance between third weld zone 128 and fourth weld zone 132 in third unwelded zone 130 where each weld zone contacts sole structure 140 and heel support 142 is indicated as spacing 232.

The illustration of FIG. 13 depicts the same portion of shoe 200 shown in FIG. 12. However, the illustration of FIG. 13 shows the same portion of shoe 200 in a flexed state, as shown in FIG. 7. Similar to FIG. 12, FIG. 13 depicts an embodiment of third unwelded flex zone 130 located between third weld zone 128 and fourth weld zone 132. Further, the distance between third weld zone 128 and fourth weld zone 132 at a specific distance from the sole structure in third unwelded zone 130 is indicated as spacing 240.

Further, FIG. 13 depicts the movement that takes places in third unwelded flex zone 130 during use. When at rest, third unwelded flex zone 130 may be in its original position (FIG. 12). However, when in use and flexed, third unwelded flex zone 130 may flex as sole structure 140 flexes. As can be seen in FIG. 13, as the third unwelded flex zone 130 flexes, the distance between the distance between third weld zone 128 and fourth weld zone 132 at a specific distance from the sole structure in third unwelded zone 130 changes. In other words, spacing 240 may be substantially smaller than spacing 230. However, spacing 232 (shown in both FIG. 12 and FIG. 13), which is a distance between third weld zone 128 and fourth weld zone 132 along sole structure 140, remains substantially the same in both the unflexed and flexed positions.

Again, the unwelded flex zone of the embodiment of a shoe upper, as shown in the comparative illustrations of FIGS. 12 and 13, may be selectively located on the upper to be configured to flex in a similar manner as the foot inside the shoe flexes. In addition, the eyelets may also be selectively located on the upper to allow the unwelded flex zone to flex unencumbered when the shoe flexes. A shoe upper having flex zones that mimic the flexing of the foot may provide a more comfortable shoe. Further, a shoe upper having flex zones may limit excess movement of the foot relative to the sole structure and the upper. Still further, a shoe upper having flex zones may ensure that the foot remains properly positioned relative to the sole structure.

Figure 15:
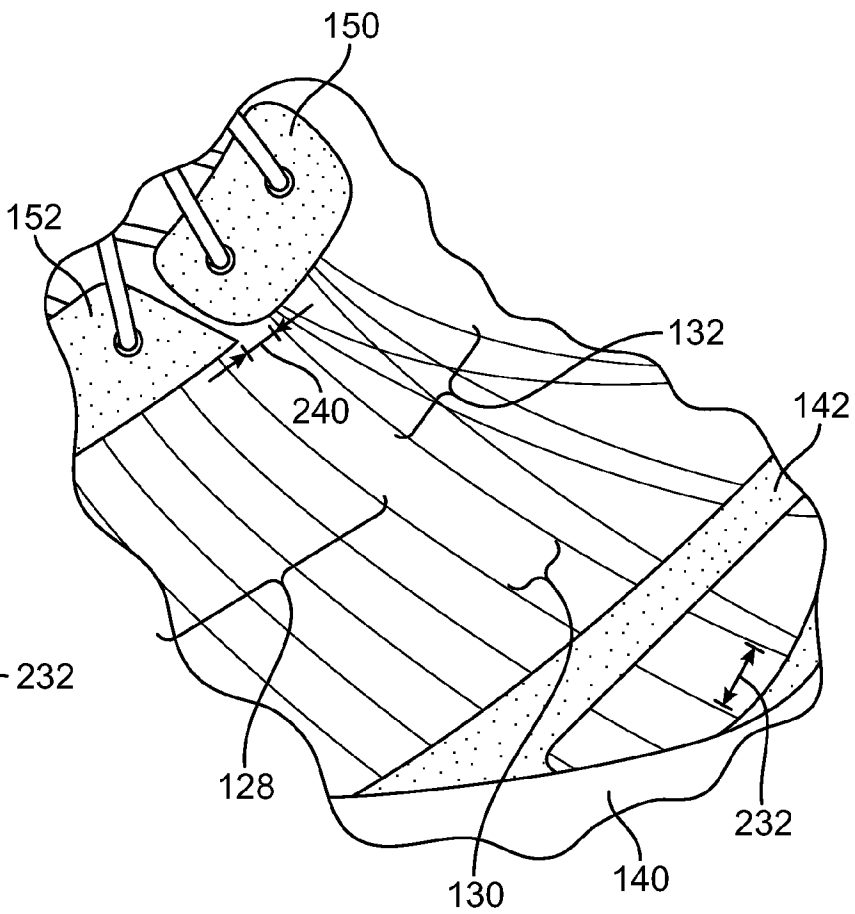
FIG. 15 is a schematic diagram of a portion of an embodiment of a shoe upper in the flexed position.
Figure 14:
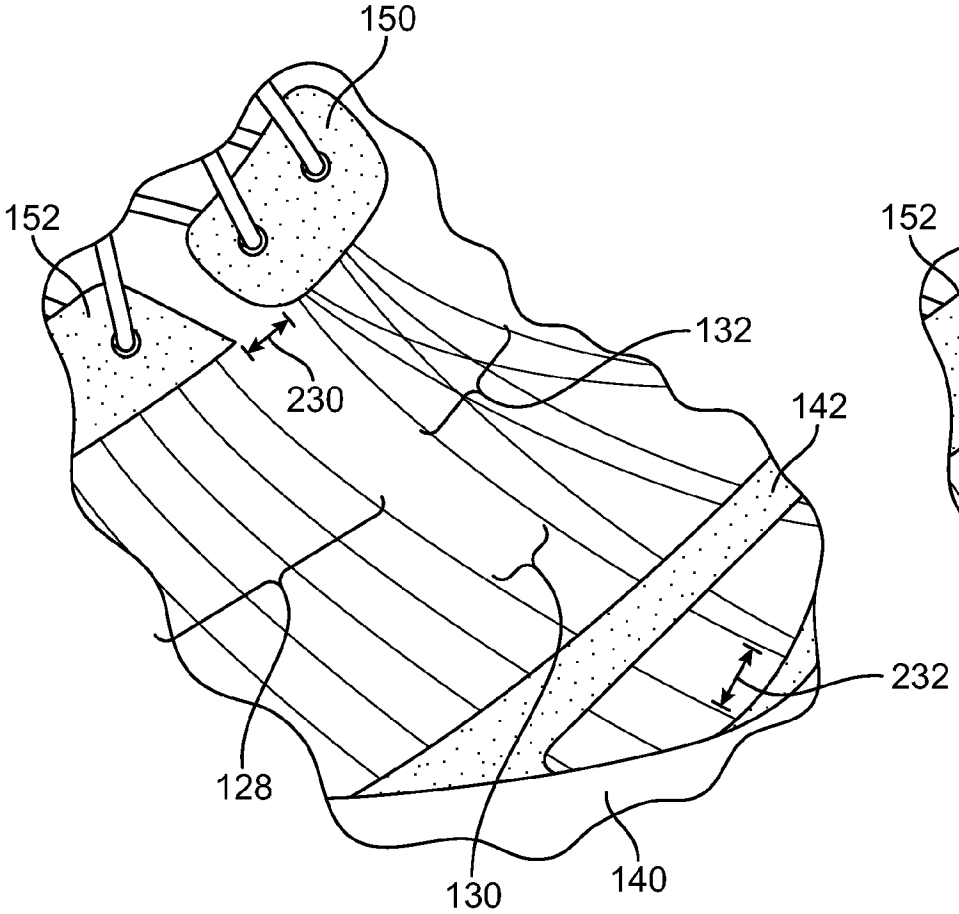
FIG. 14 is a schematic diagram of a portion of an embodiment of a shoe upper in the unflexed position.

FIGS. 14 and 15 illustrate another unwelded zone of the upper of shoe 100. The illustration of FIG. 14 depicts a portion of shoe 100 at rest or in its flexed position, as shown in FIG. 1. Third unwelded flex zone 130 may be located between third weld zone 128 and fourth weld zone 132. Further, second eyelet portion 152 and third eyelet portion 150 are also shown. Second eyelet portion 152 may be located adjacent to third weld zone 128. Third eyelet portion 150 may be located adjacent to fourth weld zone 132. Third unwelded flex zone 130 may continue between the weld zones from sole structure 140 through and between second eyelet portion 152 and third eyelet portion 150. The distance between second eyelet portion 152 and third eyelet portion 150 in third unwelded zone 130 is indicated as spacing 230. The distance between third weld zone 128 and fourth weld zone 132 where the zones contact sole structure 140 and heel support 142 is indicated as spacing 232.

The illustration of FIG. 15 depicts the same portion of shoe 100 shown in FIG. 14. However, the illustration of FIG. 15 shows the same portion of the shoe in a flexed state, as shown in FIG. 5. Similar to FIG. 14, FIG. 15 depicts an embodiment of third unwelded flex zone 130 located between third weld zone 128 and fourth weld zone 132. Further, third unwelded flex zone 130 also is located between second eyelet portion 152 and third eyelet portion 150. Still further, the distance between second eyelet portion 152 and third eyelet portion 150 is indicated as spacing 240.

Further, FIG. 15 depicts the movement that takes places in third unwelded flex zone 130 during use. When at rest, third unwelded flex zone 130 may be in its original position (FIG. 14). However, when in use and flexed, third unwelded flex zone 130 may flex as sole structure 140 flexes. As can be seen in FIG. 15, as the third unwelded flex zone 130 flexes, the distance between second eyelet portion 152 and third eyelet portion 150 changes. In other words, spacing 240 may be substantially smaller than spacing 230. However, spacing 232 (shown in both FIG. 14 and FIG. 15), which is a distance between third weld zone 128 and fourth weld zone 132 along sole structure 140, remains substantially the same in both the unflexed and flexed positions.

Again, the unwelded flex zone of the embodiment of the shoe upper, as shown in the comparative illustrations of FIGS. 14 and 15, may be selectively located on the upper to flex in a similar manner as the foot inside the shoe flexes. In addition, the material surrounding the eyelets may also be selectively located on the upper to allow the unwelded flex zone to flex unencumbered. A shoe upper having flex zones that mimic the flexing of the foot may provide a more comfortable shoe. Further, a shoe upper having flex zones may limit excess movement of the foot relative to the sole structure and the upper. Still further, a shoe upper having flex zones may ensure that the foot remains properly positioned relative to the sole structure.

Based upon the above discussion, the upper portion of the shoe of this disclosure having multiple weld zones may have various configurations. Although each of these configurations are discussed separately, many of the concepts presented above may be combined to impart specific properties or otherwise ensure that upper having multiple weld zones may be optimized for a particular purpose or product.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A shoe upper comprising:

a base material forming at least a portion of an exterior of the upper, the base material including:

multiple weld zones, multiple unwelded flex zones, and multiple eyelet portions overlaid on the base material;

the multiple weld zones comprising a plurality of welds formed in the base material , the plurality of welds being fused or melted areas of the base material;

the multiple unwelded flex zones comprising areas of the base material that remain unwelded;

wherein each of the multiple weld zones, multiple unwelded flex zones, and multiple eyelet portions are disposed on a lateral side of the upper and a medial side of the upper;

wherein at least one of the lateral side and the medial side includes: (i) a first weld zone having at least two welds of the plurality of welds that extend from a to of the upper towards a lower area of the upper, (ii) a second weld zone having at least two welds of the plurality of welds that extend from a first eyelet portion towards the lower area of the upper, and (iii) a first unwelded flex zone disposed between the first weld zone and the second weld zone, wherein the first unwelded flex zone includes an unwelded portion of the base material that extends from the lower area of the upper and adjacent to the first eyelet portion; and wherein the multiple eyelet portions are selectively located and spaced apart on the shoe upper to allow unencumbered flexibility in the unwelded flex zones.

2. The shoe upper according to claim 1, wherein the lateral side of the shoe upper includes the first unwelded flex zone, a second unwelded flex zone, and a third unwelded flex zone.

3. The shoe upper according to claim 2, wherein first unwelded flex zone is located in a toe box portion of the shoe upper between the first weld zone and the second weld zone; and wherein the first unwelded flex zone spans radially from the lateral side of the upper to the medial side of the upper across the toe box portion of the shoe upper.

4. The shoe upper according to claim 3, wherein the second unwelded flex zone is located between the second weld zone and a third weld zone;

the third weld zone haying at least two welds of the plurality of welds that extend from a second eyelet portion towards the lower area of the upper; and wherein the second unwelded flex zone extends from the lower area of the upper and is further located between the first eyelet portion and a second eyelet portion.

5. The shoe upper according to claim 4, wherein the third unwelded flex zone is located between the third weld zone and a fourth weld zone;

the fourth weld zone haying at least two welds of the plurality of welds that extend from a third eyelet portion towards the lower area of the upper; and wherein the third unwelded flex zone extends from the lower area of the upper and is further located between the second eyelet portion and the third eyelet portion.

6. The shoe upper according to claim 2, wherein the medial side of the shoe upper further includes a fourth unwelded flex zone and a fifth unwelded flex zone.

7. The shoe upper according to claim 6, wherein the fourth unwelded flex zone is located between a fifth weld zone and a sixth weld zone;

the fifth weld zone having at least two welds of the plurality of welds that extend from a fourth eyelet portion towards the lower area of the upper;

the six weld zone having at least two welds of the plurality of welds that extend from a fifth eyelet portion towards the lower area of the upper; and wherein the fourth unwelded flex zone extends from the lower area of the upper and is further located between the fourth eyelet portion and the fifth eyelet portion.

8. The shoe upper according to claim 7, wherein the fifth unwelded flex zone is located between the sixth weld zone and a seventh weld zone;

the seventh weld zone having at least two welds of the plurality of welds that extend from a sixth eyelet portion towards the lower area of the upper; and wherein the fifth unwelded flex zone is further located between the fifth eyelet portion and the sixth eyelet portion.

9. A shoe comprising an upper and a sole structure attached to the upper, the upper further comprising:

a base material forming at least a portion of an exterior of the upper, the base material including:

multiple weld zones, multiple unwelded flex zones, and multiple eyelet portions overlaid on the base material;

the multiple weld zones comprising a plurality of welds formed in the base material , the plurality of welds being fused or melted areas of the base material;

the multiple unwelded flex zones comprising areas of the base material that remain unwelded;

wherein each of the multiple weld zones, multiple unwelded flex zones, and multiple eyelet portions are disposed on a lateral side of the upper and a medial side of the upper;

wherein at least one of the lateral side and the medial side includes: (i) a first weld zone having at least two welds of the plurality of welds that extend from a to of the upper towards a lower area of the upper, (ii) a second weld zone having at least two welds of the plurality of welds that extend from a first eyelet portion towards the lower area of the upper, and (iii) a first unwelded flex zone disposed between the first weld zone and the second weld zone, wherein the first unwelded flex zone includes an unwelded portion of the base material that extends from the lower area of the upper and adjacent to the first eyelet portion;

an outer heel support overlaid on the base material spanning from the medial side to the lateral side of the upper; and wherein the multiple eyelet portions are selectively located and spaced apart on the shoe upper to allow unencumbered flexibility in the unwelded flex zones.

10. The shoe according to claim 9, wherein the lateral side of the shoe upper further includes the first unwelded flex zone, a second unwelded flex zone, and a third unwelded flex zone, and the first weld zone, the second weld zone, a third weld zone and a fourth weld zone;

the upper further comprising a toe cap overlaid on the base material spanning from the medial side to the lateral side of the upper; and wherein the first unwelded flex zone extends radially from the lateral side of the shoe to the medial side of the shoe between the toe cap and laces to allow for flexibility between the toe cap and an instep of the shoe upper.

11. The shoe according to claim 10, wherein the second unwelded flex zone is located on the lateral side of the upper between the second weld zone and the third weld zone;

the third weld zone having at least two welds of the plurality of welds that extend from a second eyelet portion towards the lower area of the upper; and wherein the second unwelded flex zone extends upwards along the upper from the sole structure and is located between the first eyelet portion and the second eyelet portion.

12. The shoe according to claim 11, wherein the medial side of the shoe upper further includes a fourth unwelded flex zone, a fifth unwelded flex zone, and a fifth weld zone, a sixth weld zone and a seventh weld zone; and wherein the fourth unwelded flex zone is located on the medial side of the upper between the fifth weld zone and the sixth weld zone; and wherein the fourth unwelded flex zone extends upwards along the upper from the sole structure and is located between a fourth eyelet portion and a fifth eyelet portion.

13. The shoe according to claim 12, where the second unwelded flex zone on the lateral side of the upper corresponds to the fourth unwelded flex zone on the medial side of the upper.

14. The shoe according to claim 13, wherein the third unwelded flex zone is located on the lateral side of the upper between the third weld zone and the fourth weld zone; and wherein the third unwelded flex zone extends upwards along the upper from the sole structure and is located between the second eyelet portion and a third eyelet portion.

15. The shoe according to claim 14, wherein the fifth unwelded flex zone is located on the medial side of the upper between the sixth weld zone and a seventh weld zone; and wherein the fifth unwelded flex zone extends upwards along the upper from the sole structure and is located between the fifth eyelet portion and a sixth eyelet portion.

16. The shoe according to claim 15, wherein the third unwelded flex zone on the lateral side of the upper corresponds to the fifth unwelded flex zone on the medial side of the upper.

17. A shoe comprising an upper and a sole structure attached to the upper, the upper further comprising:

a base material forming at least a portion of an exterior of the upper, the base material including:

multiple weld zones, multiple unwelded flex zones, and multiple eyelet portions overlaid on the base material;

the multiple weld zones comprising a plurality of welds formed in the base material, the plurality of welds being fused or melted areas of the base material;

the multiple unwelded flex zones comprising areas of the base material that remain unwelded;

wherein each of the multiple weld zones, multiple unwelded flex zones, and multiple eyelet portions are disposed on a lateral side of the upper and a medial side of the upper;

wherein at least one of the lateral side and the medial side includes: (i) a first eyelet portion having at least two welds of the plurality of welds that extend from a to of the upper towards a lower area of the upper, (ii) a second eyelet portion having at least two welds of the plurality of welds that extend from the to of the upper towards the lower area of the upper, and (iii) at least one unwelded flex zone disposed between the plurality of welds, wherein the at least one unwelded flex zone includes an unwelded portion of the base material that extends from the lower area of the upper and between the first eyelet portion and the second eyelet portion; and wherein the multiple eyelet portions are selectively located and spaced apart on the shoe upper to allow unencumbered flexibility in the unwelded flex zones.

18. The shoe according to claim 17, wherein each of the multiple eyelet portions further comprises at least two eyelets for receiving a lace.

19. The shoe according to claim 17, wherein each of the multiple eyelet portions disposed on the upper corresponds to one of the multiple weld zones; and wherein at least two welds of the plurality of welds extend from each multiple eyelet portion towards the lower area of the upper.

20. The shoe according to claim 17, wherein the upper further comprises:

a toe strap;

a toe cap overlaid on the base material spanning from the medial side to the lateral side of the upper; and an outer heel support overlaid on the base material spanning from the medial side to the lateral side of the upper.

* * * * *